US006763990B2

(12) United States Patent
Lee

(10) Patent No.: US 6,763,990 B2
(45) Date of Patent: Jul. 20, 2004

(54) ROTARY COVER HEAD OF NAIL GUN

(76) Inventor: Yun-Chung Lee, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/208,705

(22) Filed: Jul. 30, 2002

(65) Prior Publication Data

US 2004/0020964 A1 Feb. 5, 2004

(51) Int. Cl.[7] ..... B25C 7/00
(52) U.S. Cl. ..... 227/130; 227/136; 227/112
(58) Field of Search ..... 227/5, 8, 112, 227/130, 136; 173/169, 218, 138

(56) References Cited

U.S. PATENT DOCUMENTS 3,427,928 A * 2/1969 Bade ..... 91/305
3,635,605 A * 1/1972 Hall et al. ..... 417/315
3,713,573 A * 1/1973 Goldsworthy et al. ..... 226/7
4,856,696 A * 8/1989 Seld ..... 227/130
4,915,013 A * 4/1990 Moraht et al. ..... 91/307
5,575,051 A * 11/1996 Moore ..... 29/243.523
5,715,986 A * 2/1998 Sauer ..... 227/130

* cited by examiner

*Primary Examiner*—Scott A. Smith
*Assistant Examiner*—Nathaniel Chukwurah

(57) ABSTRACT

A rotary cover head of a nail gun is disclosed. The nail gun has a separable head cover at a head of a body of the nail gun. A second air channel is formed in the head; and an aperture is formed on the second air channel. A first air channel is formed in the head cover; and the first air channel is formed with an opening. A lower end of the head cover and a top of the head of the nail gun are formed with respective lock surfaces which are coupled to each other. Each locking surface is formed with a circular air channel; the circular air channel cause the aperture of the head is communicated to the opening of the head cover. Thereby, the firing valve of the nail gun can be actuated by a trigger so as to cause the head cover can be assembled and detached easily.

4 Claims, 4 Drawing Sheets

ROTARY COVER HEAD OF NAIL GUN

FIELD OF THE INVENTION

The present invention relates to components of nail guns, and particularly to a rotary cover head of a nail gun, in that the head cover is made as a rotary over and has air channels which are communicated to a trigger so as to actuate a firing valve.

BACKGROUND OF THE INVENTION

The nail gun of the present invention is a nail-beating tool which uses a pneumatic pressure as a power source.

The prior art nail gun is connected to an air-pressure tube at a distal end thereof so as to load pneumatic pressure to the gun body. A trigger is used to control pneumatic pressure for beating nails. In general, the head of the nail gun has a head cover. The head cover is formed with air channels which are communicated. Thereby, by using the pneumatic pressure to switch a trigger, the nail can be beaten.

In the prior art, generally, only a few screws (generally four screws) are used to lock the head cover to the head of the nail gun so that the air channel in the head cover is precisely connected to the air channel of the head. However, this prior art way is inefficient, especially in detaching and assembling the head cover since a plurality of screws must be used in these processes. As a result much labors are required and the efficiency of automaization is low.

SUMMARY OF THE INVENTION

Accordingly the primary object of the present invention is to provide a rotary cover head of a nail gun which can be assembled and detached easily.

To achieve above object, the present invention provides a rotary cover head of a nail gun. The nail gun has a separable head cover at a head of a body of the nail gun. A second air channel is formed in the head; and an aperture is formed on the second air channel. A first air channel is formed in the head cover and the first air channel is formed with an opening. A lower end of the head cover and a top of the head of the nail gun are formed with respective lock surfaces which are coupled to each other. Each locking surface is formed with a circular air channel. The second air channel causes the aperture of the head is communicated to the opening of the head cover. Thereby, the firing valve of the nail gun can be actuated by a trigger so as to cause the head cover can be assembled and detached easily.

The various objects and advantages of the present invention will be more readily understood from the following detailed description when read in conjunction with the appended drawing.

DETAILED DESCRIPTION OF THE PREFERRED EMBODIMENTS

Figure 1:
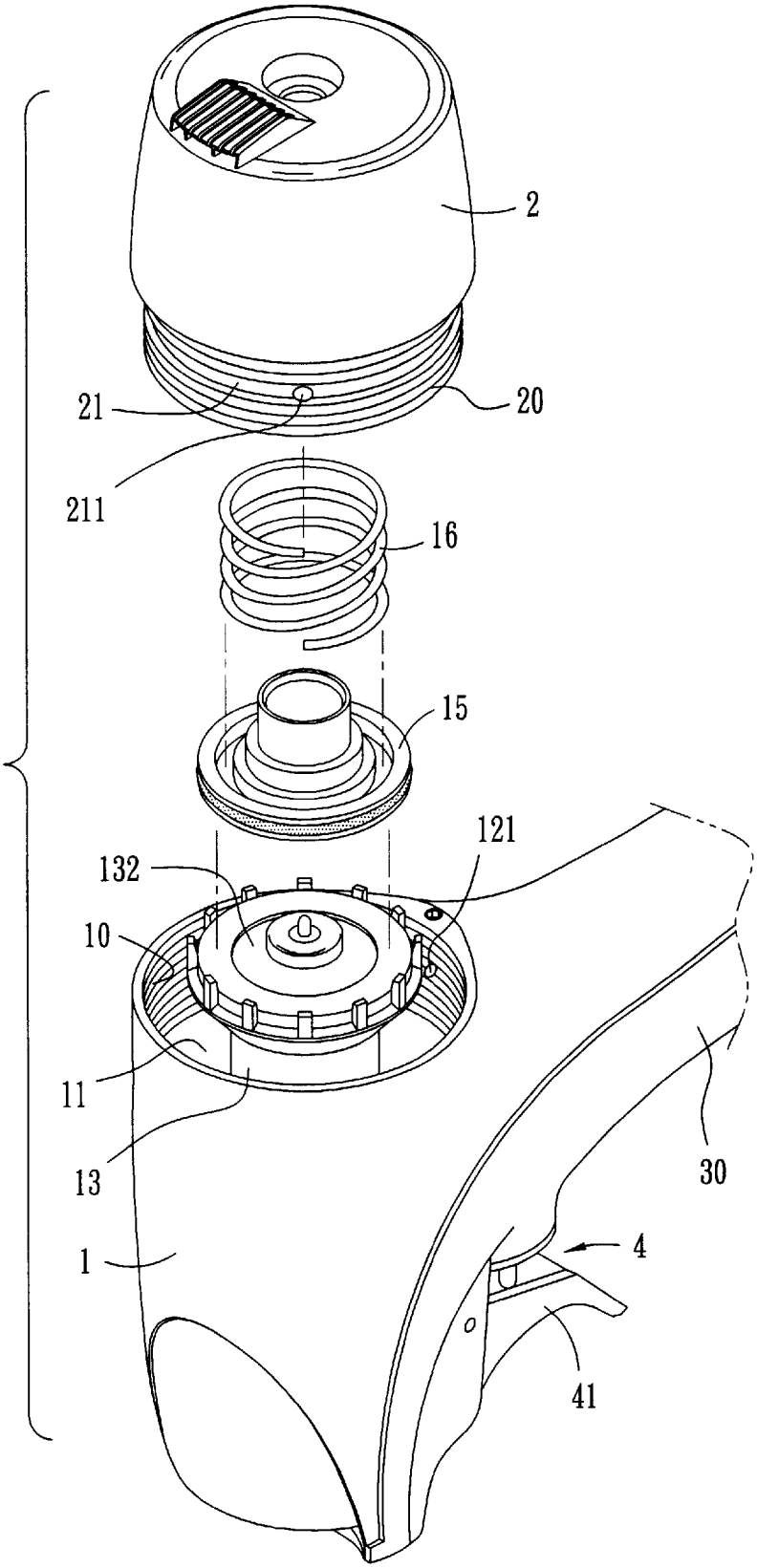
FIG. 1 is a perspective view of the present invention.

Referring to FIG. 1, the rotary cover head of a nail gun of the present invention is illustrated. In the present invention, a head cover 2 is installed at a top of the head cover 2 of the nail gun.

The outer wall of the lower end of the head cover 2 is formed with outer thread 20 (referring to FIG. 1). The inner wall of the head cover 2 is formed with a first air channel 22 (referring to FIG. 2). The outer thread 20 is formed with a circular air channel 21 (referring to FIG. 1). The circular air channel 21 is formed with an opening 221. The opening 221 is communicated with the first air channel 22 (referring to FIG. 2).

Figure 2:
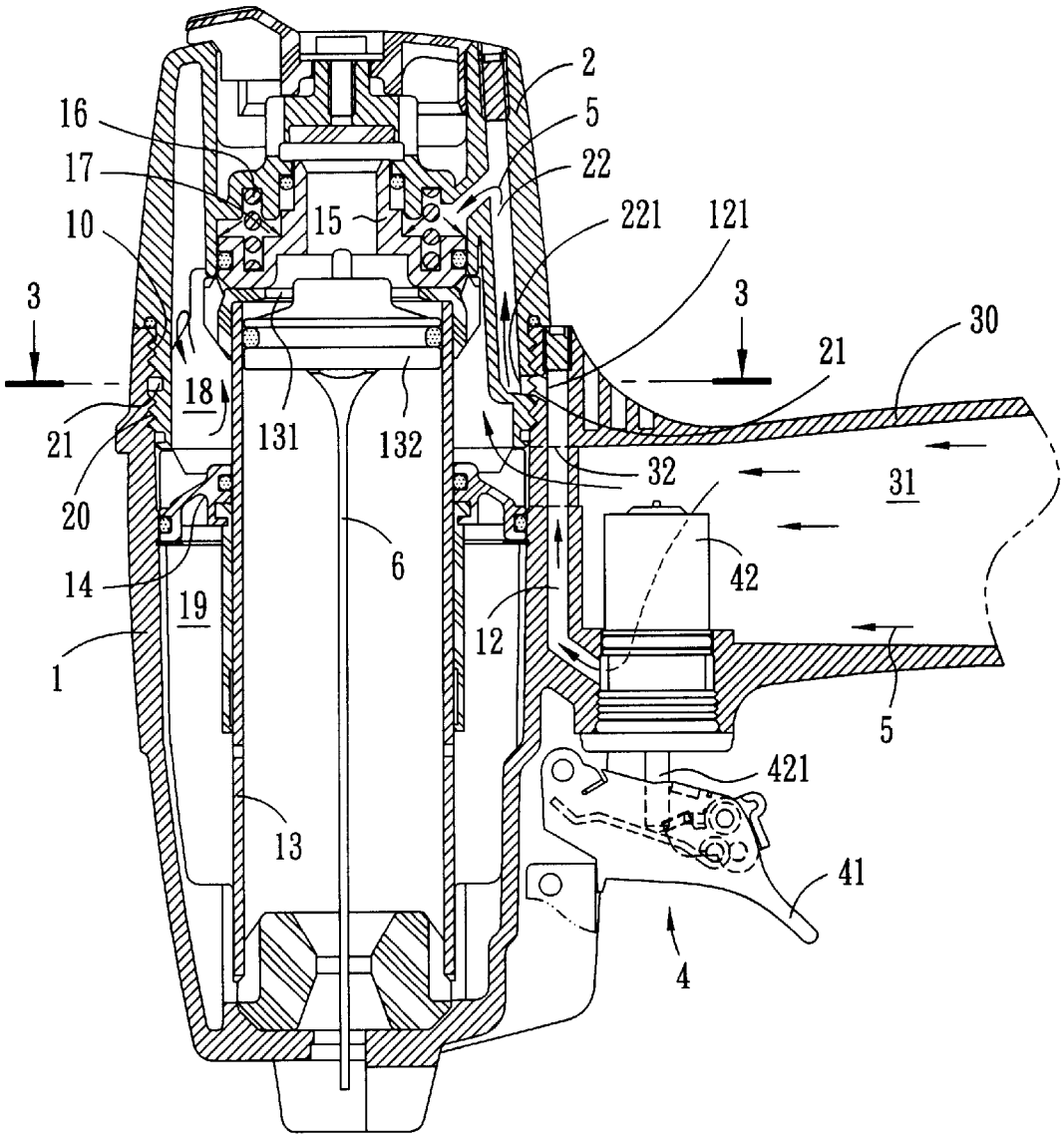
FIG. 2 is a cross section view of the present invention, in that the plug is not triggered.

The head 1 is formed with a cavity 11 and a second air channel 12 (referring to FIGS. 1 and 2). The inner wall of the top of the cavity 11 is formed with inner thread 10 (referring to FIG. 1). An aperture 121 is formed on the inner thread 10. The aperture 121 is communicated with the second air channel 12 (referring to FIG. 2).

By above said structure, the head cover 2 can be locked to the head 1 of the nail gun. Moreover, the head cover 2 can be assembled to or detached from the head 1 easily.

When the head cover 2 is fixed to the head 1 (referring to FIGS. 1 and 2), the cylinder 13, air resist diaphragm 14, firing valvefiring valve 15, spring 16 and other components are also assembled to the cavity 11 of the head 1. The cavity 11 is spaced with a first air chamber 17, a second air channel 18 and a third air channel 19 (referring to FIG. 2).

When the trigger 41 is not pressed (referring to FIG. 2), the main air chamber 31 of the handle 30 is communicated to the first air chamber 17 and second air channel 18 of the head 1. The pneumatic pressure 5 enters into an air-resist valve 42 from the main air chamber 31 of the handle 30, and then enters into the second air channel 12 from the air-resist valve 42. Then, the pneumatic pressure 5 enters into the circular air channel 21 from the aperture 121 on one end of the second air channel 12. Then the pneumatic pressure 5 enters into the first air channel 22 from the opening 221 on the circular air channel 21. Finally, the pneumatic pressure 5 enters into the first air chamber 17 of the first air channel 22. Meanwhile, the pneumatic pressure 5 enters into the third air channel 32 from the main air chamber 31 of the handle 30 and then enters into the second air channel 18 from the third air channel 32. Thereby, the pneumatic pressures 5 of the first air chamber 17 and second air channel 18 are equilibrium. Then, by the spring 16 on the firing valvefiring valve 15, the firing valvefiring valve 15 will press upon the cylinder opening 131 of the cylinder 13 for isolating the cylinder 13 from outer environment. Thereby, the nail-beating plug 132 will be positioned at a top of the cylinder 13 and at the same time, the nail-beating rod 6 is in a non-trigger status.

Figure 4:
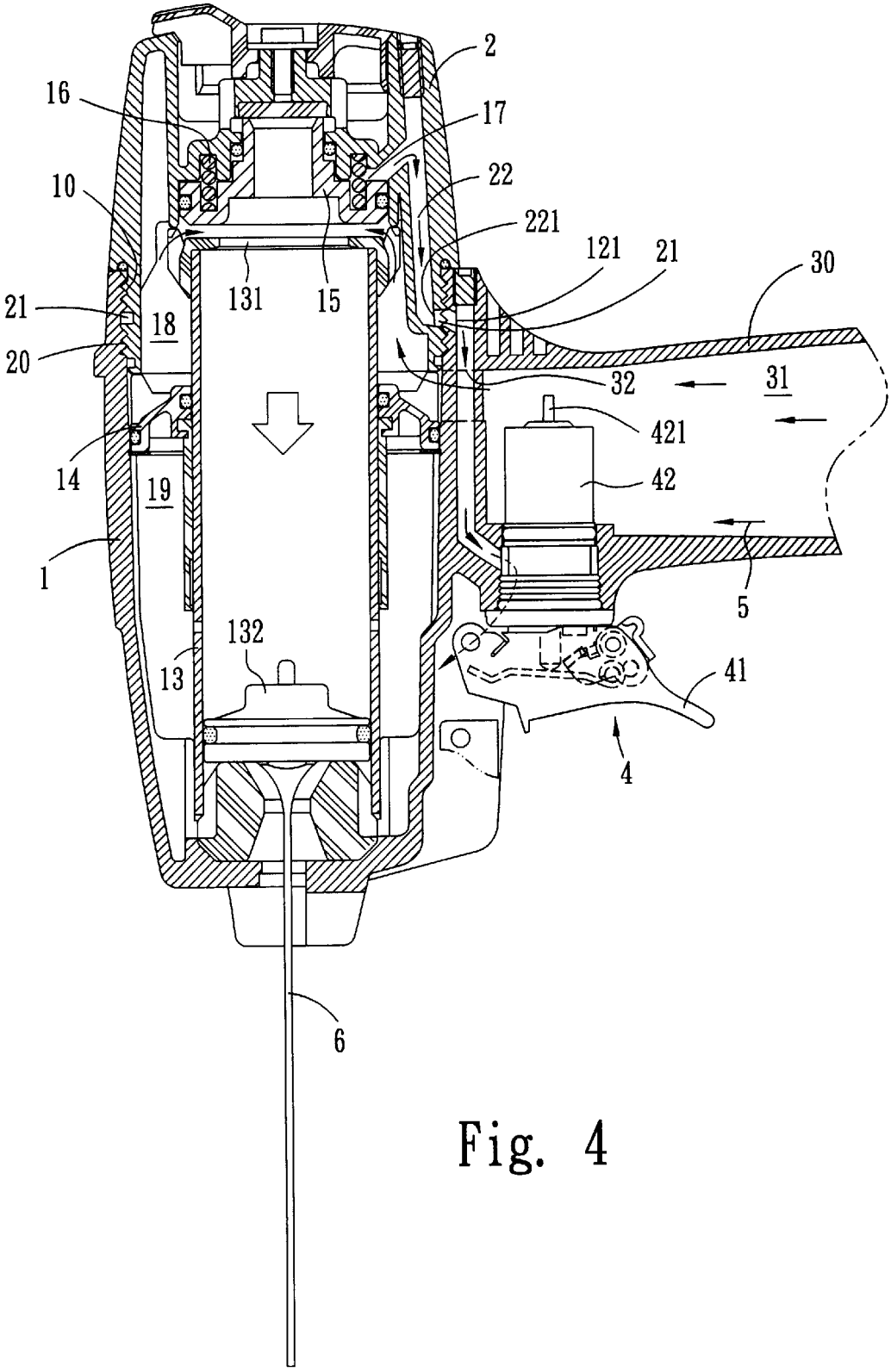
FIG. 4 is a cross section view of the present invention, in that the plug is triggered.

When the trigger 41 is pressed (referring to FIG. 4), the valve rod 421 of the air-resist valve 42 will be pressed by trigger 41 to move upwards so that the air-resist valve 42 is sealed for isolating the supply of the pneumatic pressure 5 of the first air chamber 17. Moreover, the pneumatic pressure 5 in the first air chamber 17 will disperse outwards from the gaps below the air-resist valve 42 so that the pneumatic pressure 5 of the first air chamber 17 disperses gradually When the pneumatic pressure 5 of the second air channel 18 has overcome the pneumatic pressure 5 of the first air chamber 17 and the pressure from the spring 16 applied to the firing valvefiring valve 15, the pneumatic pressure 5 of the second air channel 18 will push the firing valvefiring valve 15 upwards to resist against the cylinder opening 131 of the cylinder 13 so that the pneumatic pressure 5 of the second air channel 18 will enter into the cylinder 13 from the cylinder opening 131. By this pneumatic pressure 5, the nail-beating plug 132 is pushed toward the lower end of the cylinder 13 and the nail-beating rod 6 will move downwards for triggering.

Figure 3:
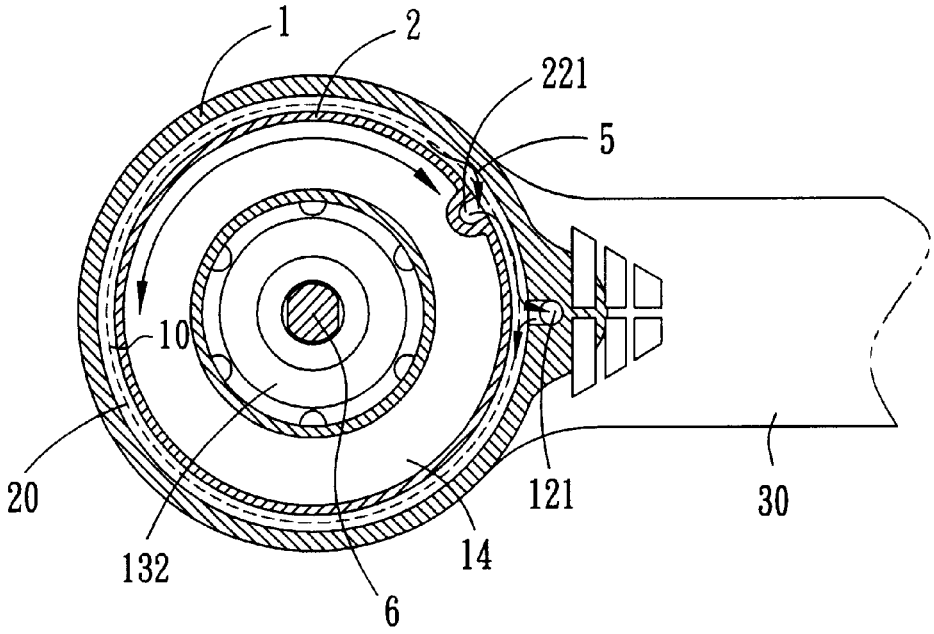
FIG. 3 is a cross section view along line 3—3 of the present invention.

It is known from above description, the head cover 2 of the present invention is made as a rotary cover. After the head cover 2 is rotated to be fixed to the head 1, the aperture 121 of the head 1 will cause the opening 221 of the head cover 2 to be communicated with the circular air channel 21 (referring to FIG. 3) so as to retain the pneumatic pressure 5 to be transferred easily and smoothly without effecting the nailing beating operation of the nail gun.

Moreover, in the present invention, by the outer thread 20 of the head cover 2 and the inner thread 10 of the head 1, the head cover 2 and head 1 of the nail gun can be locked easily (referring to FIG. 1) so that it is unnecessary to waste too much time to detach screws in repair and maintenance.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A rotary cover head of a nail gun; the nail gun having a separable head cover at a head of a body of the nail gun; a second air channel being formed in the head; and an aperture being formed on the second air channel; a first air channel being formed in the head cover; the first air channel being formed with an opening; characterized in that:

a lower end of the head cover and a top of the head of the nail gun are formed with respective lock surfaces which are coupled to each other; each locking surface is formed with a circular air channel; the circular air channel cause that the aperture of the second air channel in the head is communicated to the opening of the first air channel in the head cover.

2. The rotary cover head of a nail gun as claim in claim 1, wherein the lock surfaces are formed with an inner thread and an outer thread, respectively.

3. The rotary cover head of a nail gun as claim in claim 2, wherein the inner thread is formed with the circular air channel.

4. The rotary cover head of a nail gun as claim in claim 2, wherein the outer thread is formed with the circular air channel.

* * * * *